US008794044B2

(12) United States Patent
Ingvarsson

(10) Patent No.: US 8,794,044 B2
(45) **Date of Patent: *Aug. 5, 2014**

(54) METHOD OF BENDING METAL SHEETS AND A BENDING APPARATUS

(75) Inventor: Lars Ingvarsson, Borlange (SE)

(73) Assignee: Ortic 3D AB, Borlange (SE)

( * ) Notice: Subject to any disclaimer, the term of this patent is extended or adjusted under 35 U.S.C. 154(b) by 182 days.

This patent is subject to a terminal disclaimer.

(21) Appl. No.: 12/221,890

(22) Filed: Aug. 7, 2008

(65) Prior Publication Data

US 2009/0223272 A1 Sep. 10, 2009

Related U.S. Application Data

(63) Continuation-in-part of application No. 10/806,865, filed on Mar. 23, 2004, now Pat. No. 7,409,844, which is a continuation-in-part of application No. PCT/SE02/01689, filed on Sep. 18, 2002.

(51) Int. Cl.
*B21D 11/08* (2006.01)
*B21B 15/00* (2006.01)

(52) U.S. Cl.
CPC ..... *B21D 11/08* (2013.01)
USPC ..... 72/167; 72/177

(58) Field of Classification Search
USPC ..... 72/167, 177, 178, 179, 181, 182, 168
See application file for complete search history.

(56) References Cited

U.S. PATENT DOCUMENTS

| | | | | | |
|---|---|---|---|---|---|
| 2,098,989 | A | * | 11/1937 | Yoder | 72/178 |
| 3,073,021 | A | * | 1/1963 | Goodwill et al. | 72/177 |
| 4,233,833 | A | * | 11/1980 | Balinski | 72/180 |
| 5,253,501 | A | * | 10/1993 | Spath | 72/167 |
| 6,148,654 | A | * | 11/2000 | Jensen et al. | 72/181 |

* cited by examiner

*Primary Examiner* — Shelley Self
*Assistant Examiner* — Mohammad I Yusuf
(74) *Attorney, Agent, or Firm* — Mark P. Stone

(57) ABSTRACT

Metal sheets, and in particular, metal sheets for roofing of the kind having upstanding flat edges ending with beads, are bent by rolling the flat edges such that they become gradually thinner towards the beads. The sheets will also be bent if the beads are not rolled. Metal sheets having upstanding sides, and ends bent towards or away from the upstanding sides, are also bent by rolling the upstanding sides gradually thinner towards or away from the bent ends for forming beams for automotive components as well as other products.

13 Claims, 4 Drawing Sheets

METHOD OF BENDING METAL SHEETS AND A BENDING APPARATUS

This application is a continuation-in-part of U.S. Ser. No. 10/806,865, filed Mar. 23, 2004 now U.S. Pat. No. 7,409,844, which is a continuation-in-part of International Application PCT/SE02/01689, having an international filing date of Sep. 18, 2002, published in English under PCT Article 21(2).

TECHNICAL AREA

This invention relates to a bending apparatus for metal sheets with upstanding sides and to a method of bending metal sheets that have upstanding flat sides ending with beads.

This invention also relates to a bending apparatus of metal sheets with upstanding sides and to a method of bending sheets that have upstanding sides, including sheets having upstanding sides with ends bent in a direction towards or away from the upstanding sides.

BACKGROUND TECHNIQUE

A method of cladding a roof with metal sheets is the standing seam method in which the steel sheets have upstanding longitudinal edges that end with snap-on beads. The beads may then be rolled tight. The seams are so high that there could never be so much water on the roof that the water could reach the upper ends of the seams. The seams could for example be 8 cm high and, usually, full length sheets are used so that there are no transverse joints. This method is not used for cupola roofs whether or not they have constant or varied bending radius since the roofing sheets must then be bent before they are mounted. The sheets may be of metals such as steel, aluminum, zinc, or copper.

Automobile parts, such as automobile window frames and automobile door frames, are formed from hat beams or box beams. However, it is not known to form such automobile parts using a method which bends a metal sheet having upstanding sides with ends bent towards or away from the upstanding sides, by gradually thinning the upstanding sides by a pair of rollers for bending the metal sheet.

OBJECT OF INVENTION

It is an object of the invention to provide a bending apparatus for metal sheets, including but not limited to metal sheets for roofing, with upstanding edges, and in particular such an apparatus that permits for a variable bending radius, and to provide a method for bending a metal sheet that has upstanding flat edges ending with beads, and in particular a method of bending a sheet with a radius that varies along the length of the sheet. This is accomplished principally in that, without rolling the beads, one rolls the flat edges gradually thinner towards the beads, and in particular in that one varies the thinning.

It is a further object of the present invention to provide a method for producing automotive parts such as automotive window frames or automotive door frames in the form of hat beams or box beams, as well as other products having hat beams or box beams, by bending metal sheets having upstanding sides, including sheets with upstanding sides having ends bent towards or away from the upstanding sides. The upstanding sides are gradually thinned in a direction towards or away from the bent ends by a pair of rollers, resulting in bending of the metal sheet.

DESCRIPTION OF AN ILLUSTRATED AND PREFERRED EMBODIMENT

Figure 1:
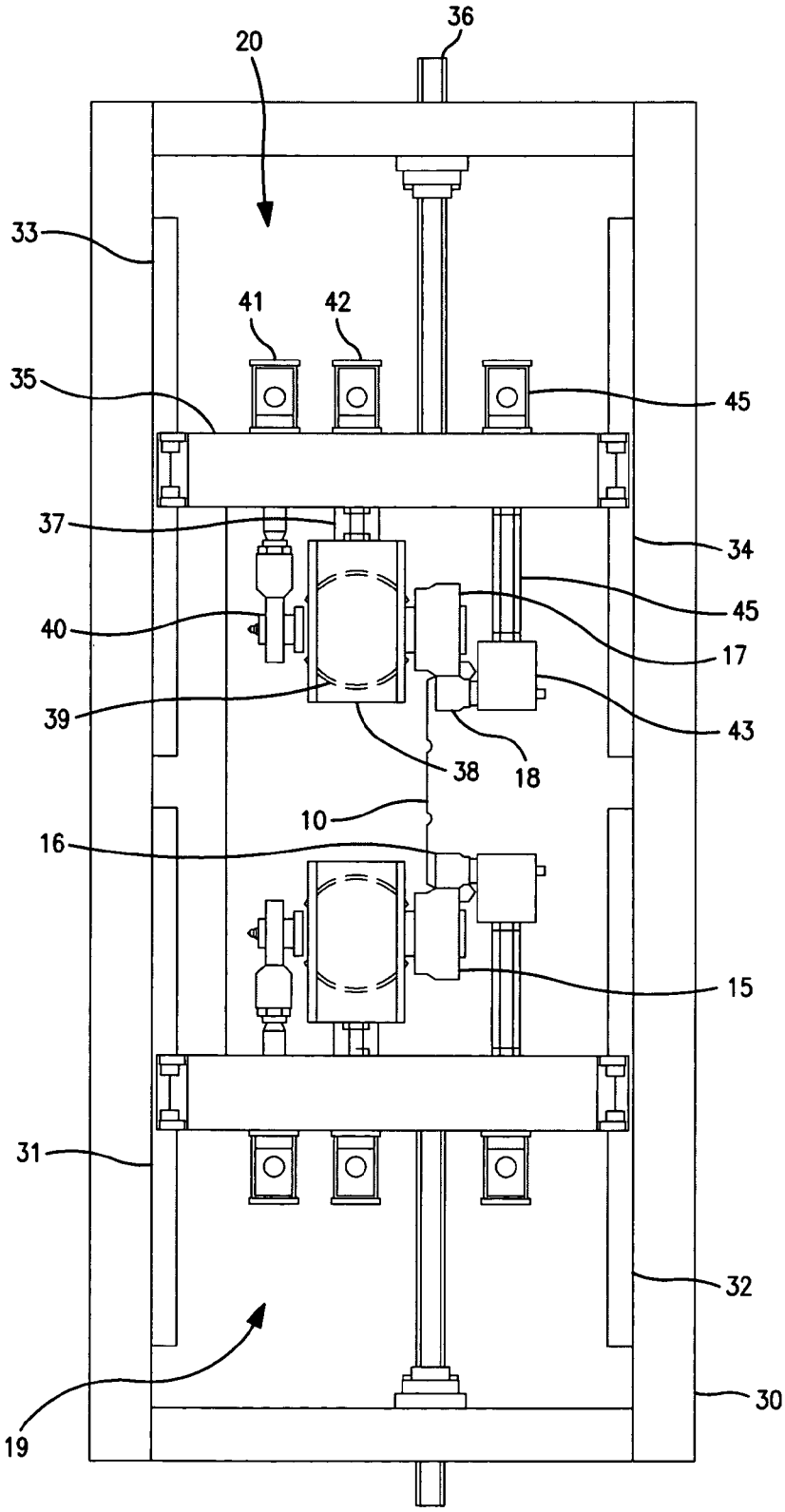
FIG. 1 shows, in a cross sectional view, the rolling unit of a bending apparatus.
Figure 2:
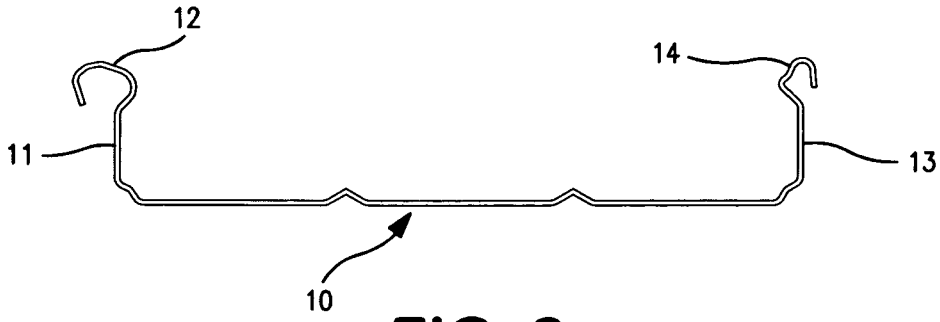
FIG. 2 shows, on a larger scale and in cross section, a metal sheet that is also shown in FIG. 1 and it is an end view seen as indicated by the arrows 2-2 in FIG. 4.
Figure 3:
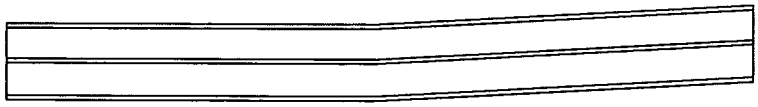
FIGS. 3-5 are examples of metal sheets that can be bent by the device shown in FIG. 1.
Figure 4:
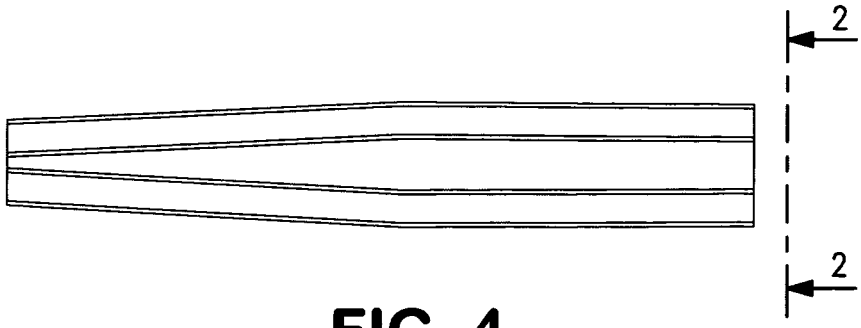
Figure 5:
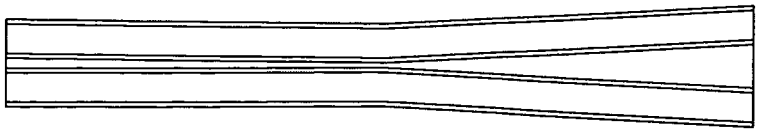

In FIG. 1, the rolling unit in a bending apparatus is shown during the rolling of a metal sheet, such as a roofing sheet 10 with upstanding edges, 11, 13 that end in beads 12, 14 as can best be seen in FIG. 2. One of the beads 12 is larger than the other bead 14 so that the beads of two adjacent sheets can be snapped together and if necessary also then be rolled sealed. The flat parts of the edges 11, 13 are clamped between two rolls 15, 16 and 17, 18, respectively, of two rolling devices 19, 20.

The rolling unit comprises a frame 30 with guides in the form of guide rails 31, 32 and 33, 34, respectively, for the two rolling devices 19, 20. Since the two rolling devices, each one for rolling an upstanding edge 11, 13, are similar, only the rolling device 20 is described in detail. It has a frame 35 that is slidably carried and guided by the guide rails 33, 34. The frame 35 can be moved along the guide rails by means of a ball screw 36. The frame 35 carries slidably on a guide 37 a bearing housing 38 in which an inner bearing part 39 is turnable. An axle 40 for the roll 17 is journaled in this bearing part 39. The bearing part 39 is turnable in the bearing housing 38 by means of a ball screw 41, and the bearing housing 38 is movable along the guide 37 by means of ball screw 42. The roll 18, the counter roll, is journalled in a housing 43, the position of which is adjustable by means of a ball screw 45.

Besides the illustrated rolling unit, the bending apparatus comprises an input unit with powered feeding-in rollers and an output unit also having powered rollers. These two units are conventional and are therefore not illustrated.

By angular adjustment of the rolls 15, 16 by means of the ball screw 41, one may roll the edges 11 and 13 gradually thinner towards beads 12 and 14, which makes the outer parts of the edges longer and bends the sheet. Surprisingly, the sheet will bend although the beads are not rolled thinner. By adjusting the obliqueness of the rolls 15, 17, one can vary the radius of bending. Since such adjustment will also displace the rolls 15, 17, one must also adjust the position of the housing 38 by means of the ball screw 42 and also adjust the position of the corresponding housing of the rolling device 19. When one wants a sheet with a varying radius of bending along its length, one can carry out these adjustments during the rolling. The ball screws can be controlled by motors controlled by a computer. The programming can be carried out based on experience, and fine adjustment can be carried out in a test rolling. In this way, one may make long roofing sheets for roofs with a varying slope. By means of the ball screw, one can adjust the device to various sheet thicknesses.

By adjusting the inclination of the rollers 15, 17 so that they roll the edges 11 and 13 thinner towards the edge base, one can also make the sheet bend somewhat upwards, but in order to get a bigger bending upwards, one may also roll the flat middle portion of the sheet. Such a rolling unit can be added to the machine for that purpose.

Figure 6:
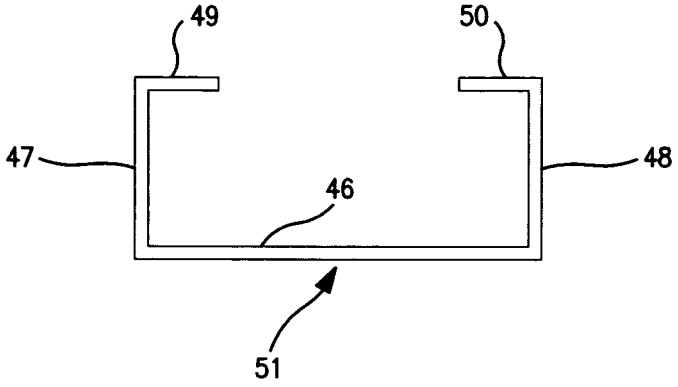
FIG. 6 is a cross section of another bent metal sheet, illustrating a further example of the configuration of bent metal sheets in accordance with the present invention.

FIG. 6 illustrates, in cross section, an example of a configuration of a metal sheet bent in accordance with the present invention. The metal sheet generally illustrated by reference numeral 51 includes a base or flat middle component 46, two upwardly bent side components 47, 48, and two inwardly bent end components 49, 50, and can be bent in the same way as the sheet shown in FIG. 2. The profile of the bent metal sheet 51 can be twisted by thinning one side upwardly and by thinning the other side downwardly. Additionally, both the width and height of the profile of the sheet can be varied by varying the positions along which the components are bent. Thus, the rolling of the metal sheet can be controlled to simultaneously produce both bending and twisting of the metal sheet.

The rolling devices 19, 20 can be moved along the guides 31-34 during the rolling so that one may roll roofing sheets of the kind shown in FIGS. 3-6 having varying width. Such sheets are adapted for example for cupola roofs. Sheets having bow-formed sides with a constant radius are adapted for cupola roofs having constant radius of their bows, whereas sheets having bow-formed sides with a varying radius are adapted for cupola roofs having varying radius of their bows. It is possible to bend sheets with a bending radius that varies along their length. Sometimes it will also be necessary to bend sheets of the kind shown in FIG. 3 which have their one side convex and their other side concave.

During the bending of a sheet, one controls the ball screws 36 so that the bending apparatus is continuously adapted to the change of the width of the sheet. The ball screws 41 and 42 are simultaneously controlled so that the bending is adapted to the change of width in accordance with algorithms defined for the form of sheet, that is, in accordance with a predefined schedule.

Instead of compulsory controlling the rolling devices 19, 20 along the guides 31-34, one can have the rolling devices freely movable along the guides so that they are guided by the upstanding edges of the sheet. A balanced pneumatic device may be provided to initially set the positions of the rolling devices on the guides and then have the sheet edges guiding their positions on the guides.

Figure 7:
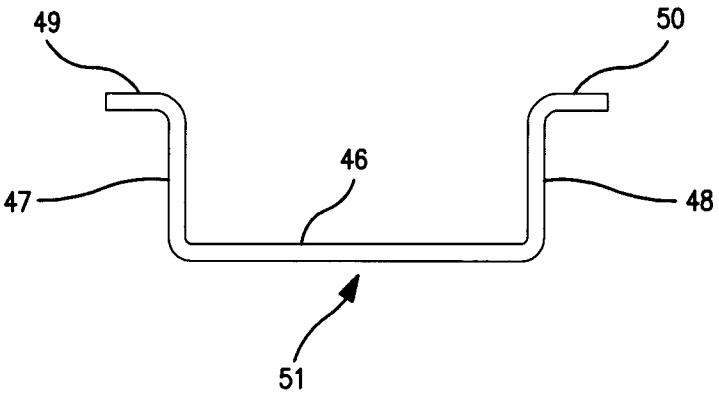
FIG. 7 is a cross section of a metal sheet with upstanding sides having ends bent in a direction away from the upstanding sides.

FIG. 7 illustrates a metal sheet designated by reference numeral 51 having opposed upstanding sides designated by reference numerals 47, 48 extending from a middle component 46. Each of the upstanding sides has an end designated by reference numeral 49, 50, respectively, which is bent in a direction outwardly from the respective upstanding sides. Preferably, the ends are bent substantially perpendicular to the upstanding sides.

The same reference numerals have been used to designate elements of the sheet illustrated by FIG. 7 as were used for FIG. 6. FIGS. 6 and 7 represent the same structure, except that ends 49, 50 in FIG. 6 are bent inwardly relative to the upstanding sides 47, 48, while the ends 49, 50 of the sheet illustrated by FIG. 7 are bent outwardly relative to the upstanding sides 47, 48.

It is also within the scope of the present invention to bend a metal sheet having a cross section illustrated by FIG. 6 or 7 of the drawing, except without having any bent ends 49, 50 of the upstanding sides.

Figure 8:
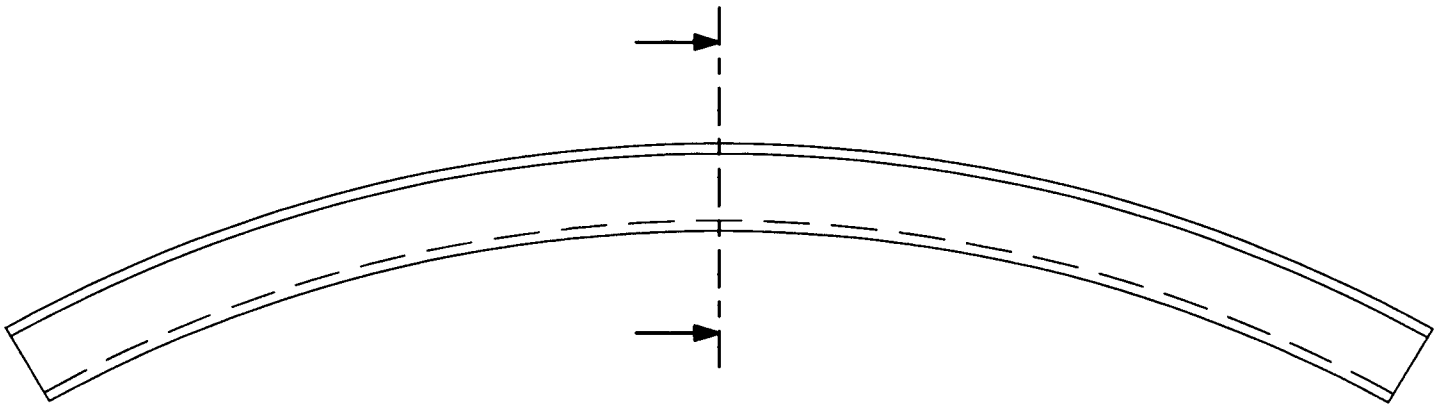
FIG. 8 illustrates the sheet of FIG. 7 bent in accordance with the method of the present invention.

Referring back to FIG. 7 of the drawing, when the upstanding sides 47, 48 are thinned in a direction towards the bent ends 49, 50, the bent ends 49, 50 are stretched, resulting in a bent profile of the metal sheet as illustrated by FIG. 8. When the upstanding sides 47, 48 are thinned in the opposite direction away from the bent ends 49, 50 and towards the central portion 46 of the metal sheet, the profile of the metal sheet will be bent in a direction opposite to that illustrated by FIG. 8.

The bending of the profile of the metal sheet illustrated by FIGS. 7 and 8 is also equally applicable to the metal sheet illustrated by FIG. 6. Moreover, the method in accordance with the present invention is also applicable to metal sheets having a cross section formed from a central portion and upstanding sides, even if the ends of the upstanding sides are not bent.

In accordance with the method of the present invention, the profile of a metal sheet having upstanding sides can be bent exclusively by selectively thinning the upstanding sides. Accordingly, the apparatus employed for bending the profile of the metal sheet can be simple and versatile. As discussed herein, the bending radius can be gradually varied during an ongoing bending process, and the bending apparatus can be constructed to bend hat beams of different size. The apparatus for bending hat beams of different sizes can readily be adapted to bend a profile with varying size along its length, in accordance with the apparatus disclosed herein.

Thus, in accordance with the method of the present invention, the metal sheets illustrated by FIGS. 6 and 7 can be bent in a first direction by thinning the upstanding sides in a first predetermined direction (e.g., towards the bent ends of the upstanding sides), and can be bent in a second direction, opposite to the first direction, by thinning the upstanding sides in a second predetermined direction (e.g., away from the bent ends of the upstanding sides). Additionally, the profile of the metal sheet can be twisted and bent simultaneously by thinning one upstanding side in a first predetermined direction (e.g., towards its bent end), while simultaneously thinning the second upstanding side in a second opposite direction (e.g., away from its bent end).

In all embodiments of the invention, it is only necessary to thin the upstanding sides of the metal sheet to result in bending of the profile of the metal sheet.

In accordance with the present invention, the metal sheet illustrated by FIG. 6 or 7 is processed by the apparatus described herein for gradually thinning the upstanding sides in a direction towards or away from the bent ends 49, 50. In this manner, the metal sheet itself is bent, without further bending the bent ends, resulting in a hat beam or box beam useful for producing automobile parts including automobile door frames and automobile window frames, as well as other products having hat beams or box beams.

The bending method for the metal sheets illustrated by FIGS. 6-7 includes the steps discussed herein with reference to FIGS. 1-5 of the drawings, including varying the angle between the two axes of the pair of rollers while rolling the upstanding sides of the metal sheet to vary the bending radius of the metal sheet; varying the rolling pressure of the rollers while rolling the upstanding sides of the metal sheet to vary the bending radius of the metal sheet; and moving the rollers relative to each other in dependence upon the width of the metal sheet.

In accordance with the methods disclosed herein, the metal sheet is bent exclusively by thinning the upstanding sides thereof without thinning the bent ends of the sheet.

As illustrated herein, the bent ends of the upstanding sides of the metal sheet can be formed as beads (FIG. 2), or be bent substantially perpendicularly to the upstanding sides, in a direction towards or away from the upstanding sides (FIGS. 6 and 7). Other configurations of the bent ends are within the scope of the present invention.

In accordance with the present invention, the bent ends of the upstanding sides of the metal sheet are pre-formed prior to bending of the metal sheet by the method disclosed herein.

The method of the present invention advantageously allows bending of the metal sheet using the same rollers for bending metal sheets of differing profiles.

Although the preferred embodiments of the invention have been discussed herein primarily with respect to metal sheets for roofing, the methods and apparatus of the present invention may also be employed for bending of metal sheets for applications other than roofing, including bending of metal sheets for producing beams as components for automobile parts such as automobile window frames and automobile door frames, or other products including beams.

Accordingly, the preferred embodiments of the invention discussed herein are intended to be illustrative only, and not restrictive of the scope of the invention, that scope being defined by the following claims and all equivalents thereto.

The invention claimed is:

1. A method of bending a metal sheet that has upstanding sides extending from a central portion, each of said upstanding sides terminating in a bent end, the steps of said method comprising:

thinning at least one said upstanding side in a predetermined direction relative to said central portion without thinning said bent end of said at least one upstanding side before, during, and after said at least one upstanding side is thinned, for bending said metal sheet.

2. The method according to claim 1, further including the step of thinning each said upstanding side in a first direction towards said bent end thereof for causing said sheet to bend in a first predetermined direction.

3. The method according to claim 1, further including the step of thinning each upstanding side in a direction away from said bent end thereof for causing said sheet to bend in a second predetermined direction.

4. The method according to claim 1, further including the steps of thinning one said upstanding side towards said bent end thereof, and thinning the other said upstanding side away from said bent end thereof, for simultaneously bending and twisting said sheet.

5. The method according to claim 2, wherein said metal sheet is a beam in which said bent end of each said upstanding side is bent in a direction outwardly from said upstanding side.

6. The method according to claim 2, wherein said metal sheet is beam in which said bent end of each said upstanding side is bent in a direction inwardly from said upstanding side.

7. The method according to claim 3, wherein said metal sheet is a beam in which said bent end of each said upstanding side is bent in a direction outwardly from said upstanding side.

8. The method according to claim 3, wherein said metal sheet is beam in which said bent end of each said upstanding side is bent in a direction inwardly from said upstanding side.

9. The method according to claim 4, wherein said metal sheet is a beam in which said bent end of each said upstanding side is bent in a direction outwardly from said upstanding side.

10. The method according to claim 4, wherein said metal sheet is a beam in which said bent end of each said upstanding side is bent in a direction inwardly from said upstanding side.

11. The method according to claim 1, wherein the step of thinning at least one said upstanding side includes the step of rolling each of said upstanding sides between two rollers, and varying the angle between the two axes of the rollers while rolling the upstanding sides to vary the bending radius of the sheet.

12. The method according to claim 1, wherein the step of thinning at least one said upstanding side includes the step of rolling each of said upstanding sides between two rollers, and varying the rolling pressure of the rollers while rolling the upstanding sides to vary the bending radius of the sheet.

13. The method according to claim 1, wherein the step of thinning at least one said upstanding side includes the step of rolling each of said upstanding sides between two rollers, and moving said rollers relative to each other in dependence upon the width of said metal sheet.

* * * * *